US006899646B2

(12) United States Patent
Conradi

(10) Patent No.: US 6,899,646 B2
(45) Date of Patent: May 31, 2005

(54) PITCHING MATE SYSTEM AND METHOD FOR BASEBALL PITCHER TRAINING

(76) Inventor: Stephen Glen Conradi, 14054 High Sierra Rd., Poway, CA (US) 92064

( * ) Notice: Subject to any disclaimer, the term of this patent is extended or adjusted under 35 U.S.C. 154(b) by 0 days.

(21) Appl. No.: 10/408,472

(22) Filed: Apr. 7, 2003

(65) Prior Publication Data

US 2004/0053711 A1 Mar. 18, 2004

Related U.S. Application Data

(60) Provisional application No. 60/411,922, filed on Sep. 18, 2002.

(51) Int. Cl.[7] ..... A63B 69/00

(52) U.S. Cl. ..... 473/454; 473/422; 473/457

(58) Field of Search ..... 473/454, 422, 473/451–453, 437, 456, 462, 476; 273/348, 407

(56) References Cited

U.S. PATENT DOCUMENTS 1,592,005 A * 7/1926 Rovane ..... 473/454
2,964,316 A * 12/1960 Rose ..... 473/454
3,271,030 A * 9/1966 Mueller ..... 473/423
5,277,679 A * 1/1994 Wells ..... 482/83
5,342,267 A * 8/1994 Adams et al. ..... 482/83
5,553,847 A * 9/1996 Surrency ..... 473/453
5,639,243 A * 6/1997 Ryan et al. ..... 473/451
5,704,855 A * 1/1998 Kellogg, Jr. ..... 473/422
5,820,496 A * 10/1998 Bergeron ..... 473/455
D416,747 S * 11/1999 Kology et al. ..... D6/608
6,030,299 A * 2/2000 Denny ..... 473/423
6,139,450 A * 10/2000 Rivers ..... 473/422
6,322,461 B1 * 11/2001 Walsh ..... 473/422
6,413,175 B1 * 7/2002 Mooney, Jr. ..... 473/417
6,651,497 B2 * 11/2003 Imatoh ..... 73/379.01
6,663,512 B2 * 12/2003 Martin ..... 473/452
2004/0077436 A1 * 4/2004 Goucher et al. ..... 473/451

* cited by examiner

*Primary Examiner*—Mitra Aryanpour
(74) *Attorney, Agent, or Firm*—Law Office of Gerald Maliszewski; Gerald Maliszewski

(57) ABSTRACT

A pitcher's motion training system and method are provided The system comprises a target with a top surface at rest in a horizontal position, and a momentary deflection position assumed in response to receiving a towel-strike. A support is included with a base for interfacing with the ground and a height adjustment mechanism. The height adjustment mechanism includes a strut mounted to the base and a telescoping member slideably engageable with the strut. The system further comprises a tensioner interposed between the target and the support. The tensioner creates tension between the target top surface and the support in the deflection position.

11 Claims, 7 Drawing Sheets

PITCHING MATE SYSTEM AND METHOD FOR BASEBALL PITCHER TRAINING

RELATED APPLICATIONS

This application claims the benefit of a provisional application entitled, PITCHER PERFECT, invented by Stephen Conradi, Ser. No. 60/411,922, filed Sep. 18, 2002.

BACKGROUND OF THE INVENTION

1. Field of the Invention

This invention generally relates to sports and fitness training equipment and, more particularly, to a system and method for training a baseball pitching motion.

2. Description of the Related Art

The motion of throwing a ball is one that must be learned. The motion requires a mixture of strength and technique. Anyone who has raised a child is aware that a "good throw" is the result of hundreds, and perhaps thousands of practice attempts. A baseball pitcher's throwing motion is particularly critical, as it must be fast, accurate, and capable of creating complex spins on the ball.

However, there are few drills to develop a pitcher's throwing motion, outside of the actual act of throwing itself. One well-known practice technique is the so-called towel-drill. The drill requires two participants; the pitcher and a second person. The pitcher uses an approximately 24 inch hand towel, folded in half over the middle finger of the throwing hand, with the ends of the towel extending approximately 12 inches. Beginning with the pitcher at rest in a standard starting pose, the second person faces and stands a distance from the pitcher dependent upon the pitcher's unique throwing style and stride. The second person horizontally extends a glove. The pitcher winds up and delivers a towel-strike to the outstretched glove. The soft glove, and the flexibility inherent in the glove's extension, dissipates the energy, preventing damage to the pitcher's arm. The finishing stance of the pitcher, the amount of energy delivered to the glove, and the placement of the towel-strike on the glove can all be used as indicators of the throwing motion. This drill can be used to enhance a pitcher's balance, arm strength, and accuracy. However, this drill is labor intensive, requiring two participants to drill a single player. Further, it is preferable that the second person be a pitching coach, to provide useful feedback in response to the towel-strikes. Hence, the pitcher can only practice the drill when a coach is available.

It would be advantageous if a pitcher could practice the towel drill without the necessity of a pitching coach or a second person to hold a glove.

It would be advantageous if a pitcher could practice the towel drill on a target that both dissipated the energy of the towel-strike in a controlled manner and provided useful feedback.

SUMMARY OF THE INVENTION

The present invention Pitching Mate™ training system is a stand-alone device that is used to assist a baseball pitcher in performing a conditioning and balancing exercise called the towel drill, without the assistance of another person. The invention is designed to allow the pitcher to throw dry pitches (a pitch without a ball). Instead of using a ball, the pitcher uses a 24" hand towel, folded in half over the middle finger of the throwing hand with the end of the towel extending 12". The purpose of the invention is to assist a pitcher in the development of sound pitching mechanics.

The drill, as practiced with the pitcher training system, develops the body's neuromuscular system in conjunction with the biomechanics of human movement, thus decreasing the likelihood of injuring a pitcher's arm and/or shoulder.

Accordingly, a pitcher's motion training system is provided comprising a target with a top surface at rest in a horizontal position, and with a momentary deflection position assumed in response to receiving a towel-strike. A support includes a base for interfacing the system with the ground. A height adjustment mechanism is also included. The height adjustment mechanism includes a strut mounted to the base and a telescoping member slideably engageable with the strut. The system further comprises a tensioner interposed between the target and the support. The tensioner creates tension between the target top surface and the support in the deflection position.

Additional details of the above-described system and a baseball pitching training method are provided below.

DETAILED DESCRIPTION OF THE PREFERRED EMBODIMENTS

Figure 1:
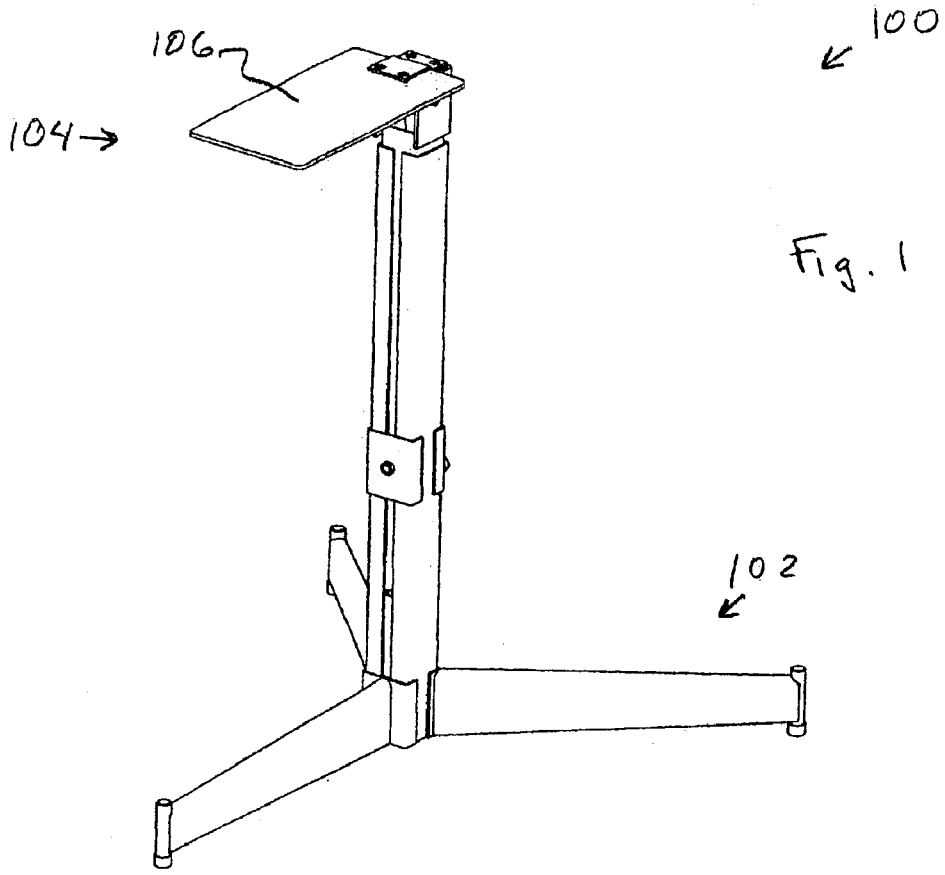
FIG. 1 is perspective drawing of the present invention pitcher's motion training system.

FIG. 1 is perspective drawing of the present invention pitcher's motion training system. The system 100 comprises a support 102 and a target 104 attached to the support 102. The target 104 has a top surface 106, at rest in a horizontal position, to receive towel-strikes. In some aspects of the system 100, the target 104 is a Plexiglas or polycarbonate material. In other aspects, the size and the shape of the target can be modified, to permit a pitcher to work on their accuracy. In some aspects the system comes equipped with a plurality of targets (not shown), each having a different form factor, to further the development of different throwing techniques.

Figure 2:
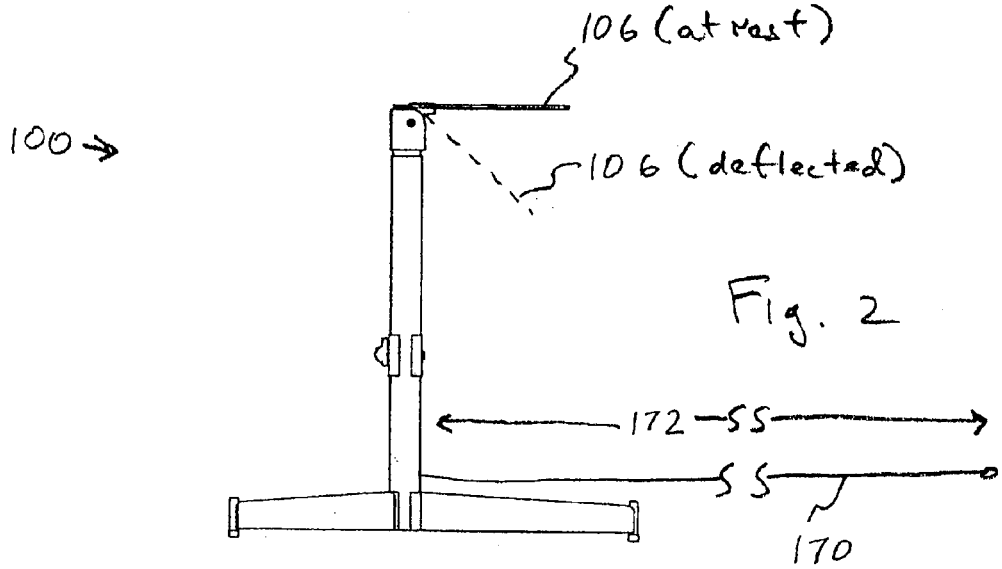
FIG. 2 is a side view of the system of FIG. 1.

FIG. 2 is a side view of the system 100 of FIG. 1. The target top surface 106 is shown with dotted lines in a momentary deflection position that is assumed in response to receiving a towel-strike. The solid lines top surface 106 represents the target (horizontal) rest position. As explained in more detail below, there is not one particular deflection position. Alternately stated, the deflection position is dependent upon the energy and placement of the towel-strike and target tension. A tensioner, described in more detail below, is interposed between the target 104 and the support 102. The tensioner creates tension between the target 104 and the support 102 when the target 104 is in the deflection position.

Figure 3:
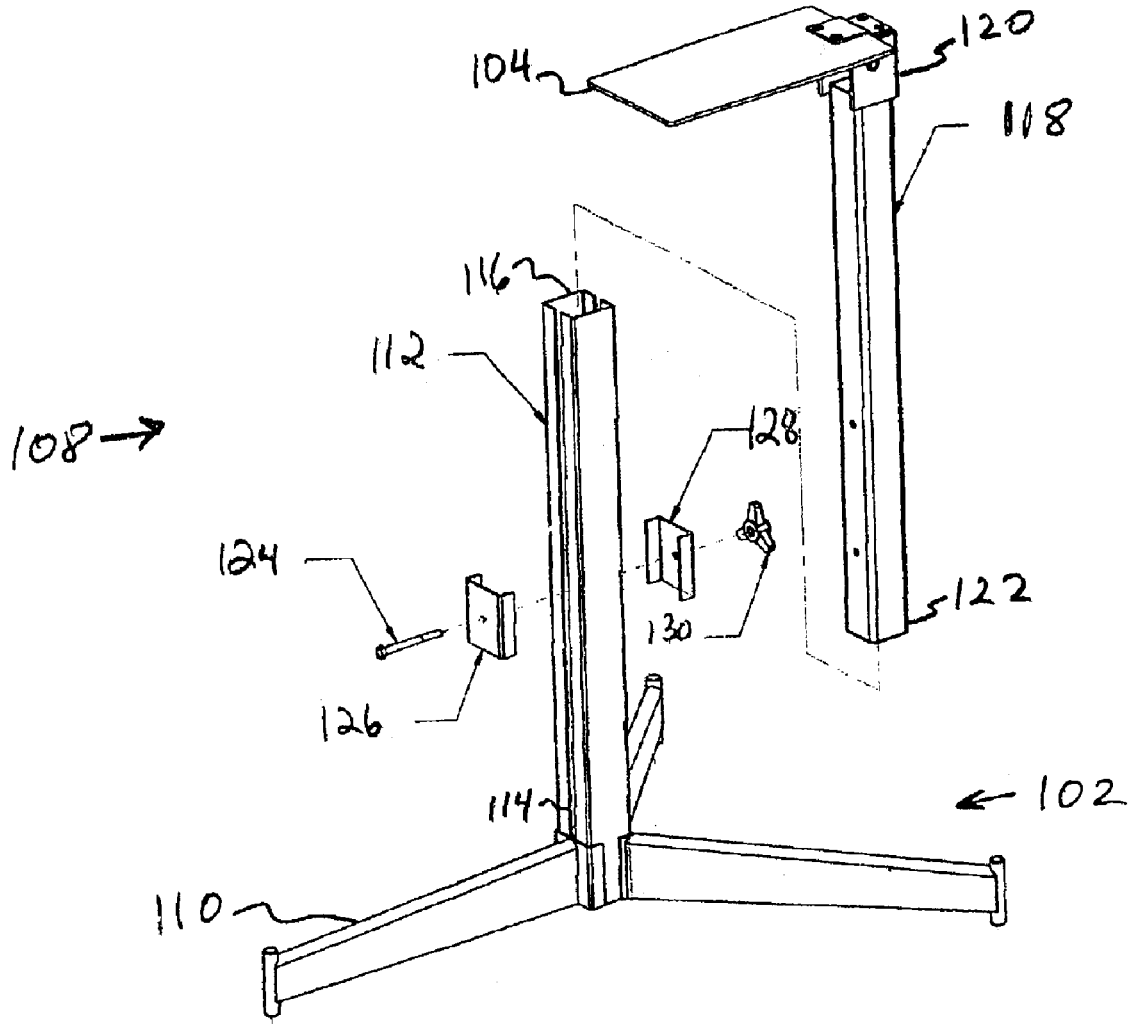
FIG. 3 is an assembly drawing of the support, and featuring a target height adjustment mechanism.

FIG. 3 is an assembly drawing of the support 102, and featuring a target height adjustment mechanism 108. The support 102 includes a base 110 to interface the system with the ground. As shown, the base 110 is a tripod. However, the invention is not limited to any particular base configuration. The target height adjustment mechanism 108 includes a strut 112 having a first end 114 mounted to the base 110, and a second end 116. A telescoping member 118 is slideably engageable with the strut 112. The telescoping member 118 has a first end 120 and a second end 122. Also shown is a clamp assemble 124/126/128/130 to securely interface the telescoping member 118 to the strut 112, once the target height has been selected. Although the height adjustment mechanism has been described as a two-piece telescoping devices, other adjustment means are known by those skilled in the art that would enable the same function.

Figure 4:
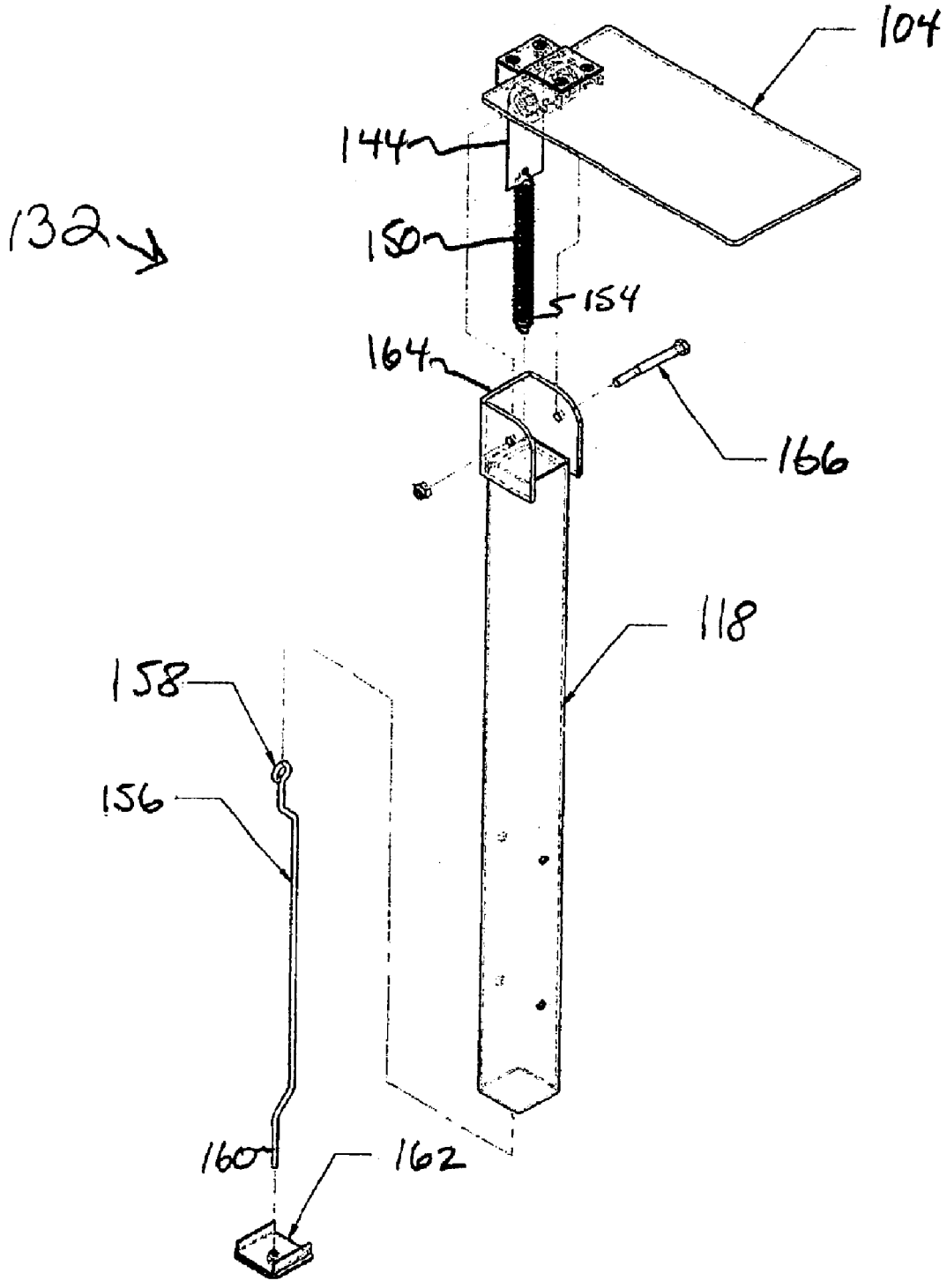
FIG. 4 is an assembly drawing featuring the tensioner.

FIG. 4 is an assembly drawing featuring the tensioner 132. Once assembled, the tensioner assembly 132 is housed internal to the telescoping member 118. The internal housing of the tensioner 132 shields and prevents damage to moving parts.

Figure 5:
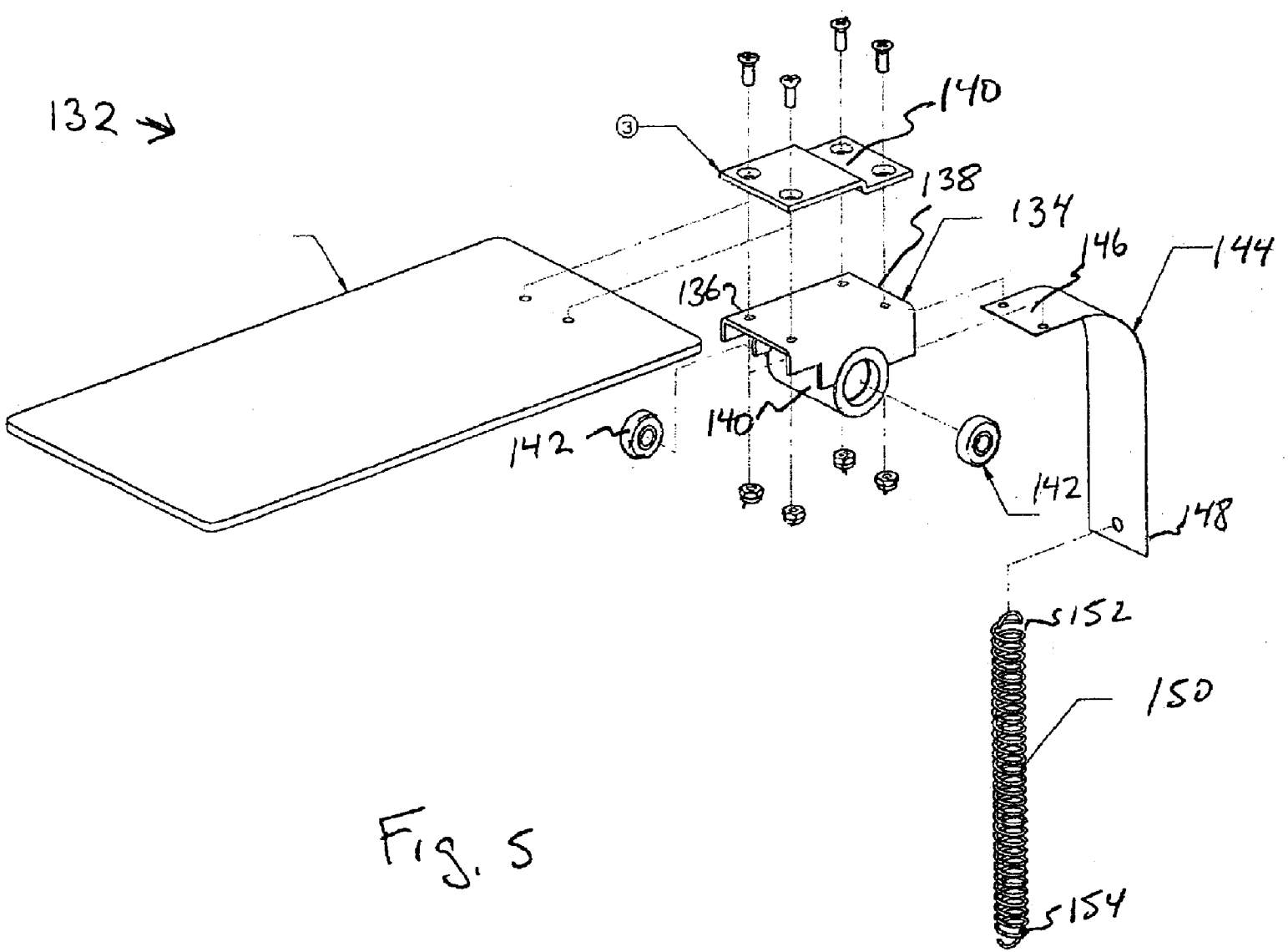
FIG. 5 is an assembly drawing featuring additional details of the tensioner of FIG. 4.

FIG. 5 is an assembly drawing featuring additional details of the tensioner 132 of FIG. 4. The tensioner 132 includes a bearing plate 134 having a first end 136 attached to the target 104, and a second end 138. A top plate 140 can be used to secure the target 104 to the bearing plate 134. A cylindrical bearings holder 140 is attached to the bearing plate 134. Bearings (not shown) are mounted in the bearings holder 140. As shown, in some aspects of the system the bearings are secured in bearings races 142. A spring metal sheet 144 has a first end 146 attached to the bearing plate second end 138. The spring metal sheet 144 has a second end 148. In some aspects, the spring metal sheet 144 is stainless steel. A coiled spring 150 has a first end 152 attached to the second end 148 of the spring metal sheet 144, and a second end 154 attached to the telescoping member.

In some aspects of the system, the tensioner 132 includes a selectable tension adjusting mechanism. Considering both FIGS. 4 and 5, the tensioner 132 further includes an adjustment screw 156 having a screw head 158 attached to the coiled spring second end 154, and a threaded end 160. A bottom cap 162 mates to the telescoping member second end 122. The bottom cap 162 is channeled or threaded to accept the adjustment screw threaded end 160. Alternately, the nut is attached to the bottom cap 162 to accept the threaded end 160. The adjustment screw 156 adjusts the tension between the tensioner 132 and the telescoping member 118. The coiled spring 150 is stretched between the sheet metal spring 144 and the adjustment screw 156 in response to moving the target 104 in the deflection position, and relaxed in response to moving the target 104 in the rest position (see FIG. 2).

In some aspects, the telescoping member first end 120 includes a top swivel bracket 164 to accept the bearing holder 140 between symmetrical openings, such as bolt holes. A fastener 166, such as a bolt, passes through the top swivel bracket openings and the bearing holder 140 to rotatably connect the bearing holder 140 to the top swivel bracket 164, through the action of the bearings.

The various elements of the above-described system can be made of commercially available metals and plastics. It would be well within expertise of one skilled in the art to select materials, and combinations of materials that would be cost effective, light, and durable. Therefore, it is not necessarily to particularly describe the range of materials from which each element can be fabricated.

Although no particular feedback mechanism is shown, it would be within the expertise of one skilled in the art to provide a feedback mechanism, so that a pitcher could measure the intensity of the towel-strikes, and indirectly gauge their throwing motions. In one aspect, the system could emit tones response to the target deflection angle. For example, a higher tone could be emitted in response to a larger deflection angle (harder towel-strike). Note that the tones can also be calibrated to an absolute energy level responsive to the deflection angle and the selected tension level. In another aspect, the feedback system could emit a light whose color or brightness varied in response to the deflection angle.

Returning to FIG. 2, a range finder 170 is depicted that is connected to the support 102 to determine a starting stance, measured with respect to the target 104. As shown, in a simple enablement, the range finder 170 is a string with a length 172 that has been calibrated to the height and motion of a particular pitcher. The pitcher extends the string range finder 170 to determine the starting position. For example, the pitcher may position their toe at the end of the string. In other embodiments the string length can be made adjustable to accommodate a plurality of pitchers. In some aspects, the starting position is determined by the type of drill that is to be performed.

In some aspects not shown, the system may include a user interface to accept a pitcher's height and supply a string length in response to the height. That is, the range finder 170 may include a calculator (not shown) with a user interface (not shown), such as a keypad, to accept user parameters and an output to supply a start position calculated in response to the user parameters. The output could be a display readout of a determined string length, or the calculator could automatically control the string length. In other aspects, the string length may be supplied in response to inputting particular pitcher identities, and a string length is then supplied from a user interface memory. It would be well within the skill of one in the art to enable the system with a laser optical system that could create a dot on the ground to indicate the pitcher's starting position, and replace the string range finder.

Figure 6:
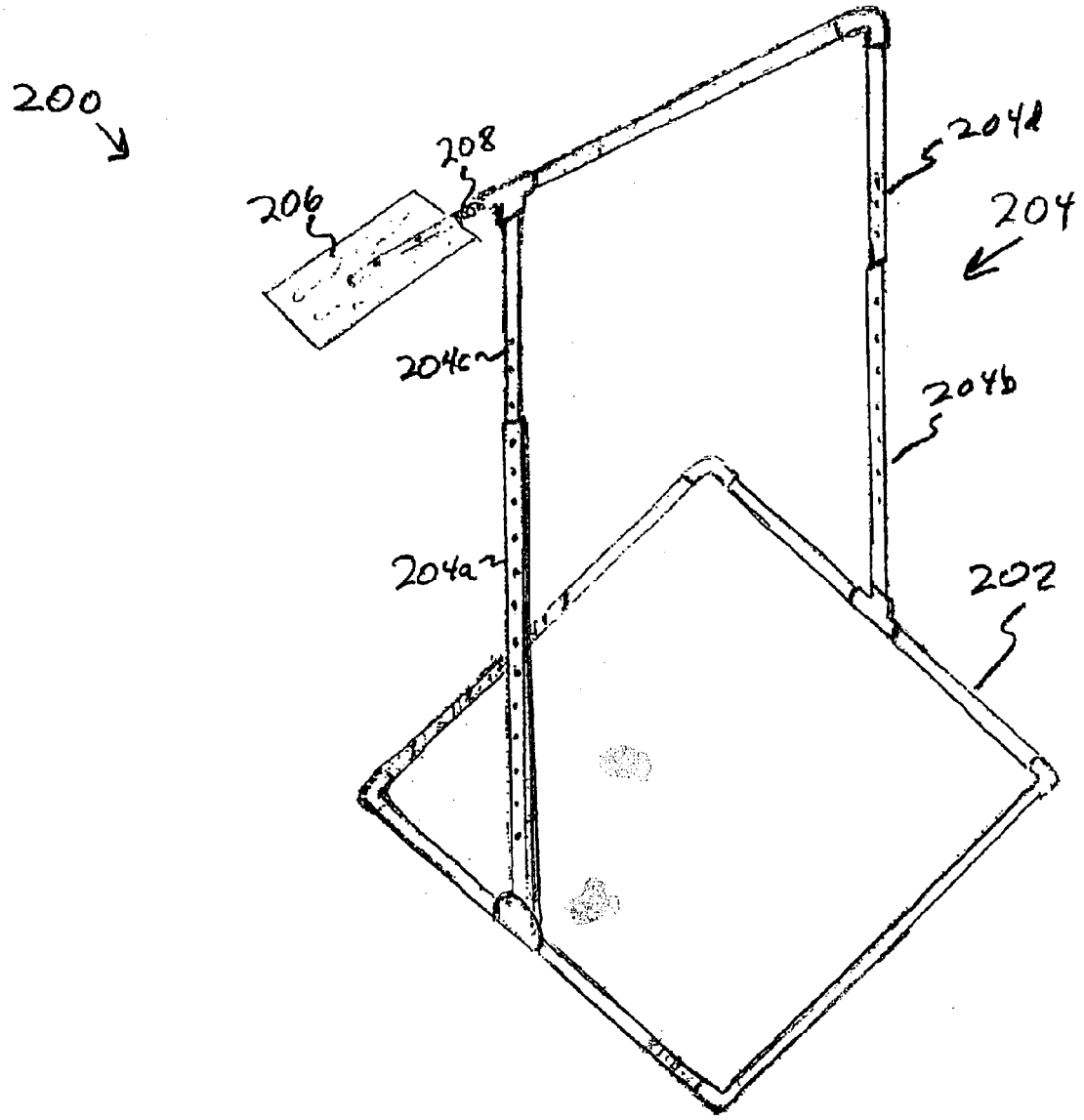
FIG. 6 is a perspective view of another aspect of the present invention pitcher's motion training system.

FIG. 6 is a perspective view of another aspect of the present invention pitcher's motion training system. This aspect of the invention illustrates that the invention can be enabled through a variety of means, besides those shown in FIGS. 1 through 5, that would be known by those skilled in the art. Briefly, the system 200 of FIG. 6 includes a base frame 202, with an adjustable bridge 204 connected to the frame 202. A striking target 206 extends from the horizontal member of the bridge 204. The system elements can be fabricated from materials including PVC pipe, aluminum, wood, steel, copper, rubber, Plexiglas, plastic, or combinations of the above-mentioned materials.

The bridge 204 includes members 204*a* and 204*b* that are fixedly connected to the base frame 202, and telescoping members 204*c* and 204*d* that are selectively engageable with the fixed members 204*a* and 204*b* to adjust the target height. In one aspect, a series of aligning holes are drilled through members 204*a*, 204*b*, 204*c*, and 204*d*. Then, pins can be inserted through the aligning holes. In one aspect, the target 206 is made of compressed wood and attached to the bridge through the use of coiled spring 208. The spring attachment means may include hinges, glue, rubber, or screws, to name a few examples.

Functional Description

System Setup

First, the pitcher adjusts the system to their personal height by manipulating the height adjustment mechanism, so the striking target is approximately even with the navel of the pitcher. After the system is adjusted to the pitcher's height, the pitcher's starting position can be determined. The starting position can be determined using a range finder, as described above, or determined manually using either the stretch or windup position. The stretch position is preferable for beginning a drill, moving to the windup position, after drills in the stretch position have been completed. The pitcher performs the setup and the drill by folding a 24" towel in half and then draping it over the middle finger of this throwing hand so that it extends 12".

To create an initial starting position, the pitcher assumes their stretch position/windup as if they were addressing the rubber on a mound with their back or posting foot. The pitcher then "marks" this as the starting point for his posting foot to create an imaginary rubber. For a right-handed pitcher, this would be the outside of the right foot; for a left-handed pitcher this would be the outside of the left foot. From this first mark the pitcher then performs the dry pitch (stretch or windup) with full effort, with the snapping towel that extends 12" from the middle finger. At the end of the dry pitch the pitcher stops and notes the placement of the landing foot. From this landing point where the pitcher's foot stops, the pitcher then walks off five (5) steps placing one foot in front of the other foot, heel to toe. The pitcher then marks the distance of this fifth ($5^{th}$) step and aligns the striking target of the system directly over the second mark, squared up to the imaginary rubber. The striking target is, then, stride plus five (5) feet from the starting position in stretch/windup. If the system is so equipped, the pitcher can log this starting position is system memory for future reference, so that the range finder can be used to supply the starting position in subsequent drills.

The Drills

Full Delivery Drill

The pitcher begins at the starting position and takes their pitching stance (stretch or windup). The pitcher addresses the striking target and performs a dry pitch, using the 24" towel draped over the middle finger of the throwing hand so the towel is 12" in length. As the pitcher strides out, the objective is to hit the striking target solidly with the towel. This part of the exercise is to be repeated until the pitcher is able to hit the striking target successfully a number of times without losing their balance. A successful hit means the towel hits the striking target soundly, at its middle to upper portion.

If the pitcher misses the striking target to the right or left, their posture must be changing during delivery. If the pitcher misses the striking target short, then their glove-side arm is moving down or back prematurely (before striking the target). The pitcher can then make adjustments that will assist in hitting the striking target successfully.

Balance Drill

Once the striking target has been struck solidly a successive number of times without losing posture or glove side, the pitcher then performs a balancing drill.

As the pitcher completes a final dry pitch, they hold the follow-through stance, as if frozen at the end of the pitch. For example, the body is extended forward, perpendicular to the ground, balancing on the landing leg. A right-handed thrower will balance on their left leg; a left-handed thrower will balance on their right leg. The posting leg (same side as his throwing arm) is extended up and behind the body, horizontal to the ground with his glove over front foot, eye high extended forward, and on-line with the striking target. The torso should be stable and parallel to the ground. This position is maintained for the duration of the exercise. Without losing balance the pitcher takes the towel with the throwing hand/arm and gently, in a small circular motion, slaps the striking target five (5) times. Once this series is completed successfully, the arm speed is increased to at least 50% of the full motion. Again, maintaining balance, the pitcher slaps the striking target five (5) times. Once this series is completed successfully, the arm speed is increased to 100% of the pitching motion. Continually maintaining balance, the pitcher hits the striking target as hard as possible five (5) times in succession. The towel drills are completed when an individual pitcher has repeated them perfectly, with repetitions and effort to tolerance.

Figure 7:
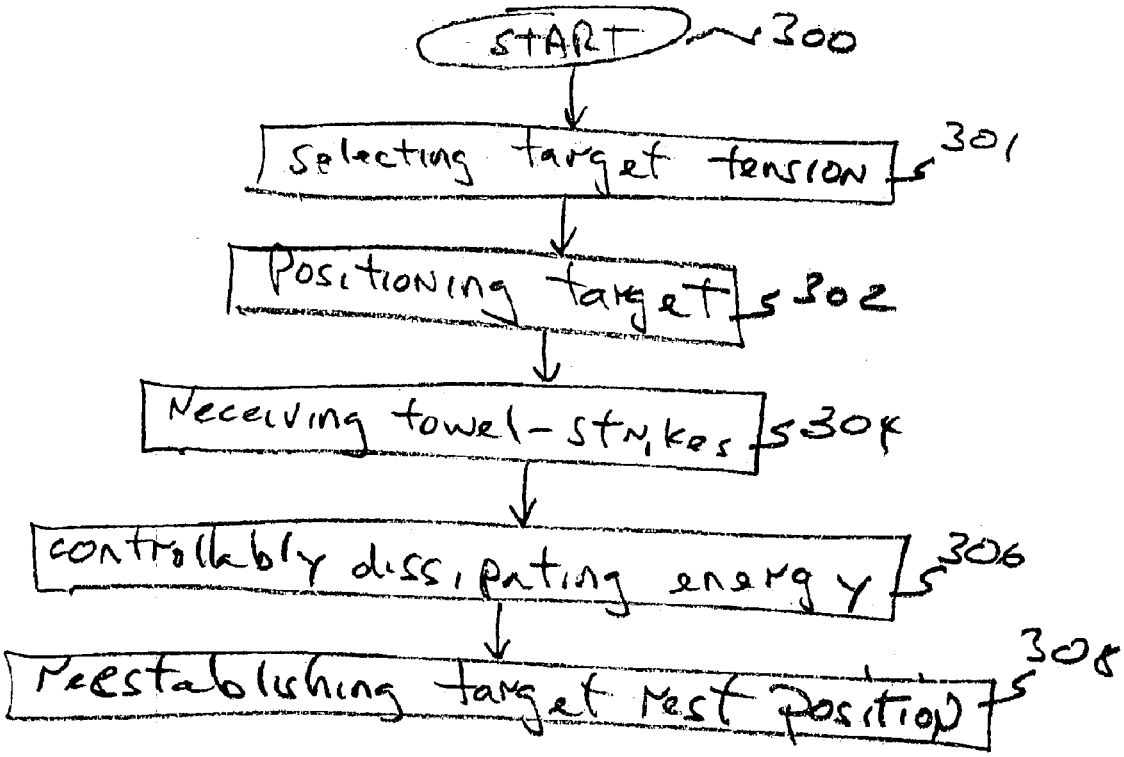
FIG. 7 is a flowchart illustrating the present invention baseball pitching training method.
Figure 8:
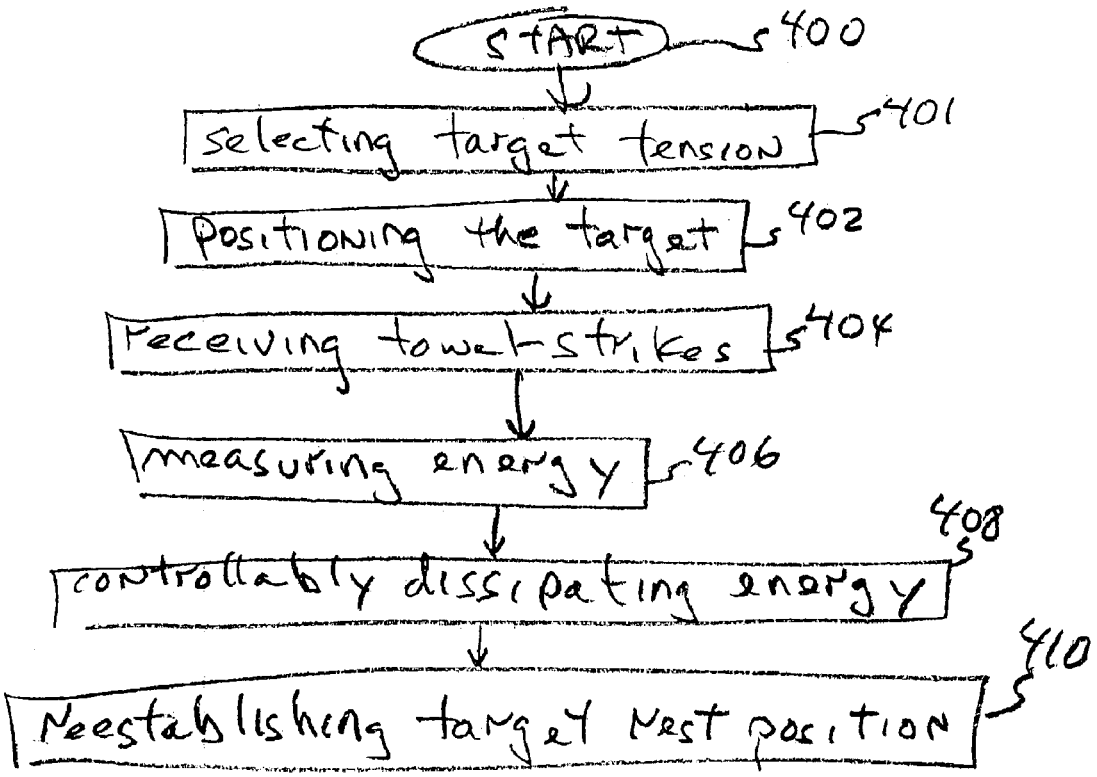
FIG. 8 is a flowchart illustrating another aspect of the present invention baseball pitching training method.

FIG. 7 is a flowchart illustrating the present invention baseball pitching training method. Although the method, and the method described by FIG. 8, is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 300.

The following description of the invention is understood to highlight a means of providing a pitcher with a stress-free means of practicing the towel drill. That is, the method permits the energy imparted by the pitcher, through the towel, to be dissipated in a manner that does not harm the shoulder or arm.

Step 302 positions a target. In some aspects, Step 302 includes selecting a target height. Step 304 receives towel-strikes on a top surface of the target. Step 306 controllably dissipates the energy received at the target from the towel-strike. In some aspects of the method, positioning a target in Step 302 includes establishing a target rest position. Then, controllably dissipating the energy received at the target from the towel-strike in Step 306 includes the target assuming a deflecting position in response to each towel-strike. In some aspects, a further step, Step 308, following the assumption of the target deflecting position, reestablishes the target rest position.

In other aspects, establishing a target rest position in Step 302 includes establishing a target top surface rest angle. Then, the target assuming a deflecting position in response to each towel-strike (Step 306) includes the target top surface assuming a deflection angle in response to each towel-strike. In some aspects, establishing a target top surface rest angle in Step 302 includes establishing a horizontal target top surface.

In other aspects, establishing a target rest position (Step 302) includes establishing a tensionable target in a tension-free position. Then, controllably dissipating the energy received at the target from the towel-strike includes deflecting the target into a target tension position, in response to towel-strikes.

In some aspects a further step, Step 301*a* selects the target tension. Then, controllably dissipating the energy received at the target from the towel-strike in Step 306 includes controlling the dissipation of energy in response to the selected target tension. Although some energy is absorbed in the system base and support, in some aspects the target tensioner is the greatest factor in the controllable dissipation of towel-strike energy.

In other aspects, positioning a target in Step 302 includes selecting a towel-strike starting stance. Then, receiving towel-strikes on a top surface of the target in Step 304 includes receiving towel-strikes initiated from the starting stance.

FIG. 8 is a flowchart illustrating another aspect of the present invention baseball pitching training method. The following description of the invention is understood to highlight a means of providing a pitcher with feedback to gauge the "success" of the towel drill. That is, the method permits the energy imparted by the pitcher, through the towel, to be measured in a manner that permits a pitcher to evaluate their throwing motion.

The method starts at Step 400. Step 401 selects a target tension. Step 402 positions the target. In some aspects Step 402 includes selecting the target height. Step 404 receives towel-strikes on a top surface of the target. Step 406 measures the energy of the received towel-strikes. In some aspects of the method a further step, Step 408, controllably dissipates the energy received at the target from the towel-strike.

In some aspects, positioning a target in Step 402 includes establishing a target rest position and measuring the energy of the received towel-strikes in Step 406 includes the target assuming a deflecting position in response to each towel-strike. In other aspects, a further step, Step 410 following the assumption of the target deflecting position, reestablishes the target rest position.

In some aspects, establishing a target rest position in Step 402 includes establishing a target top surface rest angle. Then, the target assuming a deflecting position in response to each towel-strike (Step 406) includes the target top surface assuming a deflection angle in response to each towel-strike.

In some aspects, receiving towel-strikes on a top surface of the target in Step 404 includes receiving a second towel-strike of greater intensity than a first towel-strike. Then, measuring the energy of the received towel-strikes in Step 406 includes assuming a first deflection angle in response to the first towel-strike and a second deflection angle, greater than the first deflection angle, in response to the second towel-strike.

In some aspects, establishing a target rest position in Step 402 includes establishing a tensionable target in a tension-free position. Receiving towel-strikes on a top surface of the target in Step 404 includes deflecting the target into a target tension position, in response to towel-strikes. Then, measuring the energy of the received towel-strikes in Step 406 includes measuring the difference between the target tension position and the target tension-free position.

A pitcher's training system and method have been provided. A few examples of use have been given to clearly illustrate the invention. However, the invention is not limited to merely these examples. The invention has also been described in the context of a baseball pitcher. However, it should be understood that the invention would have use in other sports where players use a type of throwing motion. Other variations and embodiments of the invention will occur to those skilled in the art.

I claim:

1. A pitcher's motion training system comprising:

a support;

a target attached to the support having a top surface, at rest in a horizontal position, and a momentary deflection position assumed in response to receiving a towel strike; and, a tensioner with a selectable tension adjusting mechanism, interposed between the target and the support, the tensioner creating tension between the target and the support when the target is in the deflection position.

2. The system of claim 1 wherein the support includes a target height adjustment mechanism.

3. The system of claim 1 further comprising:

a range finder connected to the support to determine a starting stance measured with respect to the target.

4. The system of claim 2 where the support includes a base to interface with the ground; and, wherein the target height adjustment mechanism includes:

a strut having a first end mounted to the base, and a second end; and, a telescoping member slideably engageable with the strut, having a first end and a second end.

5. The system of claim 4 wherein the tensioner is an assembly housed internal to the telescoping member.

6. The system of claim 5 wherein the tensioner includes:

a bearing plate having a first end attached to the target, and a second end;

a cylindrical bearing holder attached to the bearing plate;

bearings mounted in the bearings holder;

a spring metal sheet having a first end attached to the bearing plate second end, and a second end; and, a coiled spring having a first end attached to the second end of the spring metal sheet, and a second end attached to the telescoping member.

7. The system of claim 6 wherein the target tensioner includes:

an adjustment screw having a screw head attached to the coiled spring second end, and a threaded end; and, a bottom cap mated to the telescoping member second end and channeled to accept the adjustment screw threaded end.

8. The system of claim 7 wherein the telescoping member first end includes:

a top swivel bracket to accept the tensioner bearing holder between symmetrical openings; and, a fastener passing through the top swivel bracket openings and the bearing holder to rotatably connect the bearing holder to the top swivel bracket.

9. The system of claim 8 wherein the coiled spring is stretched between the sheet metal spring and the adjustment screw in response to moving the target in the deflection position, and relaxed in response to moving the target in the rest position.

10. A pitcher's motion training system comprising:

a plastic target including a top surface at rest in a horizontal position, and having a momentary deflection position assumed in response to receiving a towel-strike;

a single strut having a first end and a second end;

a telescoping member having a second end, slideably engageable with the strut second end, and a first end;

a plurality of feet, for interfacing with the ground, connected to strut first end;

a tensioner creating tension between the target and the support when the target is in the deflection position, the tensioner including:

a swivel bracket with symmetrical openings, connecting the telescoping member first end and the target;

a fastener passing through the swivel bracket openings, engaging the telescoping member first end; and, a coiled spring having a first end connected to telescoping member first end, and a second end operatively connected to the target.

11. A pitcher's motion training system comprising:

a support including a base to interface with the ground;

a target attached to the support having a top surface, at rest in a horizontal position, and a momentary deflection position assumed in response to receiving a towel strike; and, a target height adjustment mechanism including:

a strut having a first end mounted to the base, and a second end; and, a telescoping member slideably engageable with the strut, having a first end and a second end;

a tensioner assembly housed internal to the telescoping member, creating tension between the target and the support when the target is in the deflection position, the tensioner including:

a bearing plate having a first end attached to the target, and a second end;

a cylindrical bearing holder attached to the bearing plate;

bearings mounted in the bearings holder;

a spring metal sheet having a first end attached to the bearing plate second end, and a second end; and, a coiled spring having a first end attached to the second end of the spring metal sheet, and a second end attached to the telescoping member.

* * * * *